US008416960B2

(12) United States Patent
D'Agostino et al.

(10) Patent No.: US 8,416,960 B2
(45) Date of Patent: Apr. 9, 2013

(54) FEEDFORWARD ANR DEVICE COVER

(75) Inventors: Michael D'Agostino, Lowell, MA (US); Paul D. Gjeltema, Stow, MA (US); Patrick W. Hopkins, Amherst, NH (US); Michael Monahan, Franklin, MA (US); Richard L. Pyatt, Fitchburg, MA (US); Jonathan D. Turner, Natick, MA (US)

(73) Assignee: Bose Corporation, Framingham, MA (US)

( * ) Notice: Subject to any disclaimer, the term of this patent is extended or adjusted under 35 U.S.C. 154(b) by 500 days.

(21) Appl. No.: 12/719,908

(22) Filed: Mar. 9, 2010

(65) Prior Publication Data

US 2011/0044465 A1 Feb. 24, 2011

Related U.S. Application Data

(60) Provisional application No. 61/234,877, filed on Aug. 18, 2009.

(51) Int. Cl.
*G10K 2210/1081* (2006.01)
*H04R 5/033* (2006.01)
*G10L 21/0208* (2006.01)

(52) U.S. Cl. ..... 381/71.6; 381/74; 381/94.1

(58) Field of Classification Search ..... 381/71.6, 381/71.7, 94.1, 74
See application file for complete search history.

(56) References Cited

U.S. PATENT DOCUMENTS 4,689,822 A 8/1987 Houng
5,377,956 A 1/1995 Muller
5,692,059 A 11/1997 Kruger
5,815,582 A 9/1998 Claybaugh et al.
6,118,878 A 9/2000 Jones
6,831,984 B2 12/2004 Sapiejewski (Continued)

FOREIGN PATENT DOCUMENTS

EP 0661902 A1 7/1995
EP 0688143 A2 12/1995

(Continued)

OTHER PUBLICATIONS

International Preliminary Report on Patentability Dated Feb. 21, 2012 PCT/US2010/045702.

(Continued)

*Primary Examiner* — Duc Nguyen
*Assistant Examiner* — George Monikang

(57) ABSTRACT

An earpiece of an ANR device incorporates one or more of feedforward-based ANR; feedback-based ANR; passive noise reduction (PNR) of environmental noise sounds in the environment external to the casing of the earpiece in higher audible frequencies; a controlled leak acoustically coupling the front cavity to the environment external to the casing of the ANR device where the coupling may be through another cavity that is closable to the environment external to the casing with a leaky cover; a combination of an acoustically resistive port and a mass port coupling a rear cavity to the environment external to the casing where the coupling may be through another cavity that is closable to the environment external to the casing with a leaky cover; a feedforward microphone given acoustic access to the environment external to the casing through an aperture that is overlain with a leaky cover or that is enclosed within a cavity that is acoustically coupled to the environment external to the casing with a leak.

17 Claims, 7 Drawing Sheets

U.S. PATENT DOCUMENTS

| | | | | |
|---|---|---|---|---|
| 7,190,802 | B2 | 3/2007 | Rains et al. | |
| 2005/0257995 | A1 | 11/2005 | Harris et al. | |
| 2006/0034476 | A1 | 2/2006 | Glezerman | |
| 2007/0098195 | A1* | 5/2007 | Holmes | 381/315 |
| 2008/0166009 | A1 | 7/2008 | Dinh et al. | |
| 2008/0310645 | A1* | 12/2008 | Itabashi et al. | 381/71.6 |
| 2009/0185045 | A1 | 7/2009 | Rosenblatt et al. | |

FOREIGN PATENT DOCUMENTS

| | | | |
|---|---|---|---|
| EP | 0873040 | A2 | 10/1998 |
| GB | 2315633 | A | 2/1998 |
| JP | 4227396 | A | 8/1992 |
| WO | 9406256 | A1 | 3/1994 |

OTHER PUBLICATIONS

International Search Report and Written Opinion dated Dec. 3, 2010 for Int. Appln. No. PCT/US2010/045702.

International Search Report and Written Opinion dated Dec. 3, 2010 for Int. Appln. No. PCT/US2010/045724.

* cited by examiner

FEEDFORWARD ANR DEVICE COVER

REFERENCE TO PROVISIONAL APPLICATION

This application claims the benefit of U.S. Provisional Application Ser. No. 61/234,877 entitled FEEDFORWARD ANR DEVICE filed Aug. 18, 2009 by Pericles N. Bakalos, Michael Dagostino, Paul D. Gjeltema, Jason Harlow, Patrick W. Hopkins, Richard L. Pyatt, Martin D. Ring, Roman Sapiejewski and Jon Turner, the disclosure of which is incorporated herein by reference.

TECHNICAL FIELD

This disclosure relates to personal active noise reduction (ANR) devices to reduce acoustic noise in the vicinity of at least one of a user's ears.

BACKGROUND

Headphones and other physical configurations of personal ANR device worn about the ears of a user for purposes of isolating the users ears from unwanted environmental sounds have become commonplace. In particular, ANR headphones in which unwanted environmental noise sounds are countered with the active generation of anti-noise sounds have become very prevalent, even in comparison to headphones or ear plugs employing only passive noise reduction (PNR) technology, in which a users ears are simply physically isolated from environmental noise sounds.

Unfortunately, despite various improvements made over time, existing personal ANR devices continue to suffer from a variety of drawbacks, especially in environmental situations that tend to reduce the effectiveness of feedforward-based ANR. Where a microphone is incorporated into an ANR device as a feedforward microphone such that it is acoustically coupled to the surrounding environment to detect noise sounds as a reference input for feedforward-based ANR, instances of wind noise, noise transmitted through the structure of the ANR device to the feedforward microphone, and/or occlusions physically blocking the access of the feedforward microphone to the surrounding environment can defeat the effectiveness of the feedforward-based ANR. Especially in instances of wind noise and noise transmitted through structure, the feedforward microphone can be subjected to noises that are not correlated with any acoustic noise present within an earpiece of the ANR device.

More particularly, wind noise commonly arises when a flow of air in the surrounding environment generates one or more vortices in the vicinity of a microphone such that a diaphragm of the microphone is variously pushed and pulled by changes in air pressure occurring only in the vicinity of the microphone. Thus, the microphone detects the sounds of these highly localized vortices (often perceived as a "rumbling" sound) in addition to detecting environmental noise sounds, and the electrical output of the microphone is a signal representing this combination of sounds. Where such a microphone is employed as a feedforward microphone to provide reference noise sounds for the generation of feedforward anti-noise sounds, circuitry employed to generate those feedforward anti-noise sounds attempts to generate anti-noise sounds from the environmental noise sounds and the sounds of those highly localized vortices. Unfortunately, since those vortices are so very localized to the vicinity of the feedforward microphone, there are no acoustic noises within an earpiece of the ANR device that are correlated to the sounds of the vortices for the anti-noise sounds generated from the sounds of those vortices to interact with and attenuate. As a result, the anti-noise sounds generated from the sound of those vortices actually become additional noise sounds generated by the feedforward circuitry and acoustically output within the earpiece, such that the feedforward-based ANR function of the ANR device may actually generate more noise than it attenuates.

Further, occlusions blocking access to the surrounding environment can have a "muffling" effect such that environmental noise sounds reaching the feedforward microphone can be greatly attenuated. This muffling effect can also attenuate environmental noise sounds at different frequencies to different degrees. Thus, any circuit generating feedforward anti-noise sounds may be provided a signal from the feedforward microphone that represents an attenuated and/or distorted form of the environmental noise sounds that the feedforward microphone would have otherwise detected, thereby resulting ultimately in poorer noise attenuation.

SUMMARY

An earpiece of an ANR device incorporates one or more of feedforward-based ANR; feedback-based ANR; passive noise reduction (PNR) of environmental noise sounds in the environment external to the casing of the earpiece in higher audible frequencies; a controlled leak acoustically coupling the front cavity to the environment external to the casing of the ANR device where the coupling may be through another cavity that is closable to the environment external to the casing with a leaky cover; a combination of an acoustically resistive port and a mass port coupling a rear cavity to the environment external to the casing where the coupling may be through another cavity that is closable to the environment external to the casing with a leaky cover; a feedforward microphone given acoustic access to the environment external to the casing through an aperture that is overlain with a leaky cover or that is enclosed within a cavity that is acoustically coupled to the environment external to the casing with a leak.

In one aspect, an earpiece of an ANR device includes: a casing; a feedforward microphone carried by the casing to enable the provision of feedforward-based ANR; a feedforward aperture formed through an external surface of the casing to acoustically couple the feedforward microphone to an environment external to the casing to enable the feedforward microphone to detect noise sounds present in the environment external to the casing; and a cover structured to be disposed on the casing to overlie the feedforward aperture to provide a leaky closure over the feedforward aperture that enables the feedforward microphone to remain acoustically coupled to the environment external to the casing.

Implementations may include, and are not limited to, one or more of the following features. The outer aperture may be formed through the cover at a location that aligns with the feedforward aperture. The earpiece may further include an inset formed in the external surface of the casing; the feedforward aperture opens through the external surface at a location where the feedforward aperture opens into the inset; and the cover is structured to be disposed at least partly within the inset in a manner that provides a leak between at least one edge of the cover and a portion of the inset. A portion of the cover may protrude from the inset to prevent a foreign object with a flat face from occluding the entirety of the inset to preserve the acoustic coupling of the feedforward microphone to the environment external to the casing. A portion of the external surface of the casing may be curved; at least a portion of the inset may be formed in the curved portion of the external surface; and the curved portion of the external surface, the inset and the cover may cooperate to prevent a foreign object with a flat face from occluding the entirety of the inset to prevent the acoustic coupling of the feedforward microphone to the environment external to the casing from being lost. The cover may be ring shaped and the inset may be ring shaped so as to receive at a least a portion of the ring shape of the cover within the inset. The cover and the inset may extend about the external surface of the casing to an extent great enough to prevent the leak between the at least one edge of the cover and the portion of the inset from being entirely occluded as a result of a hand of a user of the earpiece being placed over the external surface of the casing.

The casing may define a front cavity in which an acoustic driver of the earpiece acoustically outputs at least anti-noise sounds as part of the provision of feedforward-based ANR, the front cavity having an opening structured to enable the front cavity to be acoustically coupled to an ear of a user of the ANR device; the earpiece may further include a leak aperture formed through the external surface of the casing that acoustically couples the front cavity to the environment external to the casing; and the cover may be structured to overlie the leak aperture. The earpiece may further comprise an inset formed in the external surface of the casing into which the cover is structure to be at least partly disposed; and the leak aperture may open through the external surface of the casing at a location where the leak aperture opens into the inset. The location at which the feedforward aperture opens through the external surface may be spaced apart from the location at which the leak aperture opens through the external surface to substantially prevent an occurrence of feedback in which sounds acoustically output by the acoustic driver are conveyed to the feedforward microphone through the leak aperture, along the cover and through the feedforward aperture.

The earpiece may further include an acoustic driver to acoustically output at least anti-noise sounds as part of the provision of feedforward-based ANR; the casing may define a front cavity and a rear cavity that are at least partially separated by the acoustic driver, the front cavity having an opening structured to enable the front cavity to be acoustically coupled to an ear of a user of the ANR device; the earpiece may further include at least one of a resistive port and a mass port formed through the external surface of the casing that couples the rear cavity to the environment external to the casing; and the cover may be structured to overlie the at least one of the resistive port and the mass port. The earpiece may further comprise an inset formed in the external surface of the casing into which the cover is structure to be at least partly disposed, and the at least one of the resistive port and the mass port may open through the external surface of the casing at a location where the at least one of the resistive port and the mass port opens into the inset. The earpiece may further include a leak aperture formed in the casing that acoustically couples the front cavity to the environment external to the casing; the earpiece may further include a feedback microphone disposed within the front cavity to enable the feedback microphone to detect noise sounds present in the front cavity to enable the provision of feedback-based ANR; and the location at which the feedforward aperture opens through the external surface may be spaced apart from the location at which the at least one of the resistive port and the mass port opens through the external surface to substantially prevent an occurrence of feedback in which sounds acoustically output by the acoustic driver are conveyed to the feedback microphone through the at least one of the resistive port and the mass port, along the cover and through the leak aperture.

In another aspect, an ANR device includes a first earpiece that includes: a first casing; a first feedforward microphone carried by the first casing to enable the provision of feedforward-based ANR to a first ear of a user of the ANR device; a first feedforward aperture formed through an external surface of the first casing to acoustically couple the first feedforward microphone to an environment external to the first casing to enable the first feedforward microphone to detect noise sounds present in the environment external to the first casing; and a first cover structured to be disposed on the first casing in a position overlying the first feedforward aperture to provide a leaky closure by which the first feedforward microphone remains acoustically coupled to the environment external to the first casing.

Implementations may include, and are not limited to, one or more of the following features. The ANR device may be structured to be employed in two-way communications between the user and another person, and the first feedforward microphone may be carried by the first casing a location enabling the first feedforward microphone to detect speech sounds uttered by the user to enable transmission of the detected speech sounds of the user to the other person. The ANR device may further include a second earpiece, and the second earpiece may include: a second casing; a second feedforward microphone carried by the second casing to enable the provision of feedforward-based ANR to a second ear of the user; a second feedforward aperture formed through an external surface of the second casing to acoustically couple the second feedforward microphone to an environment external to the second casing to enable the second feedforward microphone to detect noise sounds present in the environment external to the second casing; and a second cover structured to be disposed on the second casing in a position between the second feedforward aperture and the environment external to the second casing, to overlie the second feedforward aperture to provide a leaky closure by which the second feedforward microphone remains acoustically coupled to the environment external to the second casing. The ANR device may also further include a band coupling the first casing to the second casing to enable the ANR device to be worn on the user's head. The ANR device may further include a manually operable control operable by the user to signal an ANR circuit to alter at least the provision of feedforward-based ANR to the first ear of the user to enable speech sounds uttered by another person in the vicinity of the user that are detected by at least the first feedforward microphone to be acoustically output by at least a first acoustic driver of the first earpiece to at least the first ear of the user.

The first earpiece may further include a first inset formed in the external surface of the first casing; the first feedforward aperture may open through the external surface of the first casing at a location where the first feedforward aperture opens into the first inset; and the first cover may be structured to be disposed at least partly within the first inset in a manner that provides a leak between at least one edge of the first cover and a portion of the first inset. A first outer aperture may be formed through the first cover at a location that aligns with the first feedforward aperture. A portion of the external surface of the first casing may be curved; at least a portion of the first inset may be formed in the curved portion of the external surface of the first casing; and the curved portion of the external surface of the first casing, the first inset and the first cover may cooperate to prevent a foreign object with a flat face from occluding the entirety of the first inset to preserve the acoustic coupling of the first feedforward microphone to the environment external to the first casing. The first cover is ring shaped, and the first inset may be ring shaped so as to receive at a least a portion of the ring shape of the first cover within the first inset.

Other features and advantages of the invention will be apparent from the description and claims that follow.

DETAILED DESCRIPTION

What is disclosed and what is claimed herein is intended to be applicable to a wide variety of personal ANR devices, i.e., devices that are structured to be at least partly worn by a user in the vicinity of at least one of the users ears to provide ANR functionality for at least that one ear. It should be noted that although various specific embodiments of personal ANR devices, such as headphones and wireless earphones are presented with some degree of detail, such presentations of specific embodiments are intended to facilitate understanding through the use of examples, and should not be taken as limiting either the scope of disclosure or the scope of claim coverage.

It is intended that what is disclosed and what is claimed herein is applicable to personal ANR devices that provide two-way audio communications, one-way audio communications (i.e., acoustic output of audio electronically provided by another device), or no communications, at all. It is intended that what is disclosed and what is claimed herein is applicable to personal ANR devices that are wirelessly connected to other devices, that are connected to other devices through electrically and/or optically conductive cabling, or that are not connected to any other device, at all. It is intended that what is disclosed and what is claimed herein is applicable to personal ANR devices having physical configurations structured to be worn in the vicinity of either one or both ears of a user, including and not limited to, headphones with either one or two earpieces, over-the-head headphones, behind-the-neck headphones, headsets with communications microphones (e.g., boom microphones), wireless headsets (i.e., earsets), single earphones or pairs of earphones, as well as hats or helmets incorporating one or two earpieces to enable audio communications and/or ear protection. Still other physical configurations of personal ANR devices to which what is disclosed and what is claimed herein are applicable will be apparent to those skilled in the art.

Figure 1:
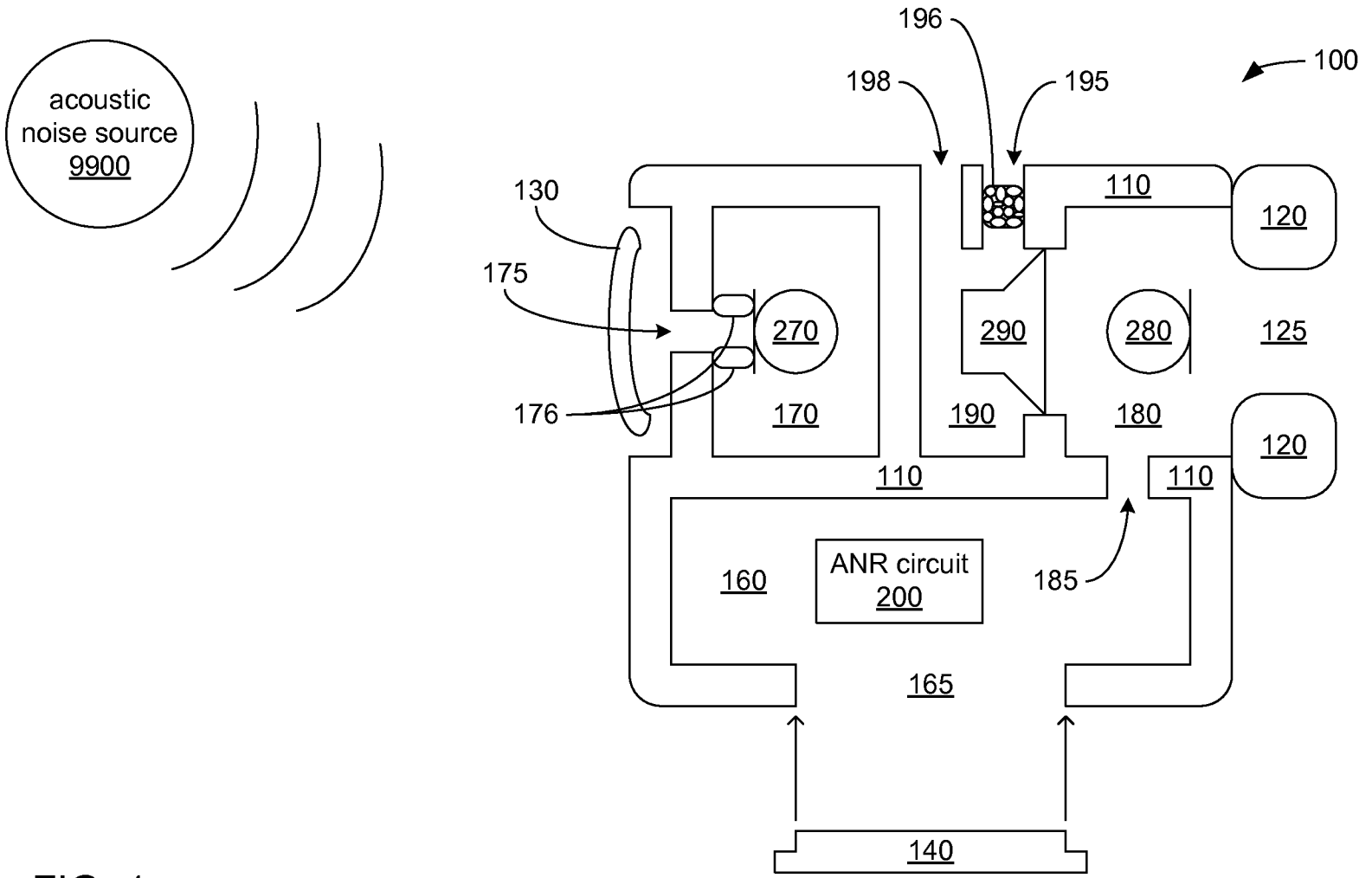
FIG. 1 is a block diagram of an earpiece of a personal ANR device.
Figure 2:
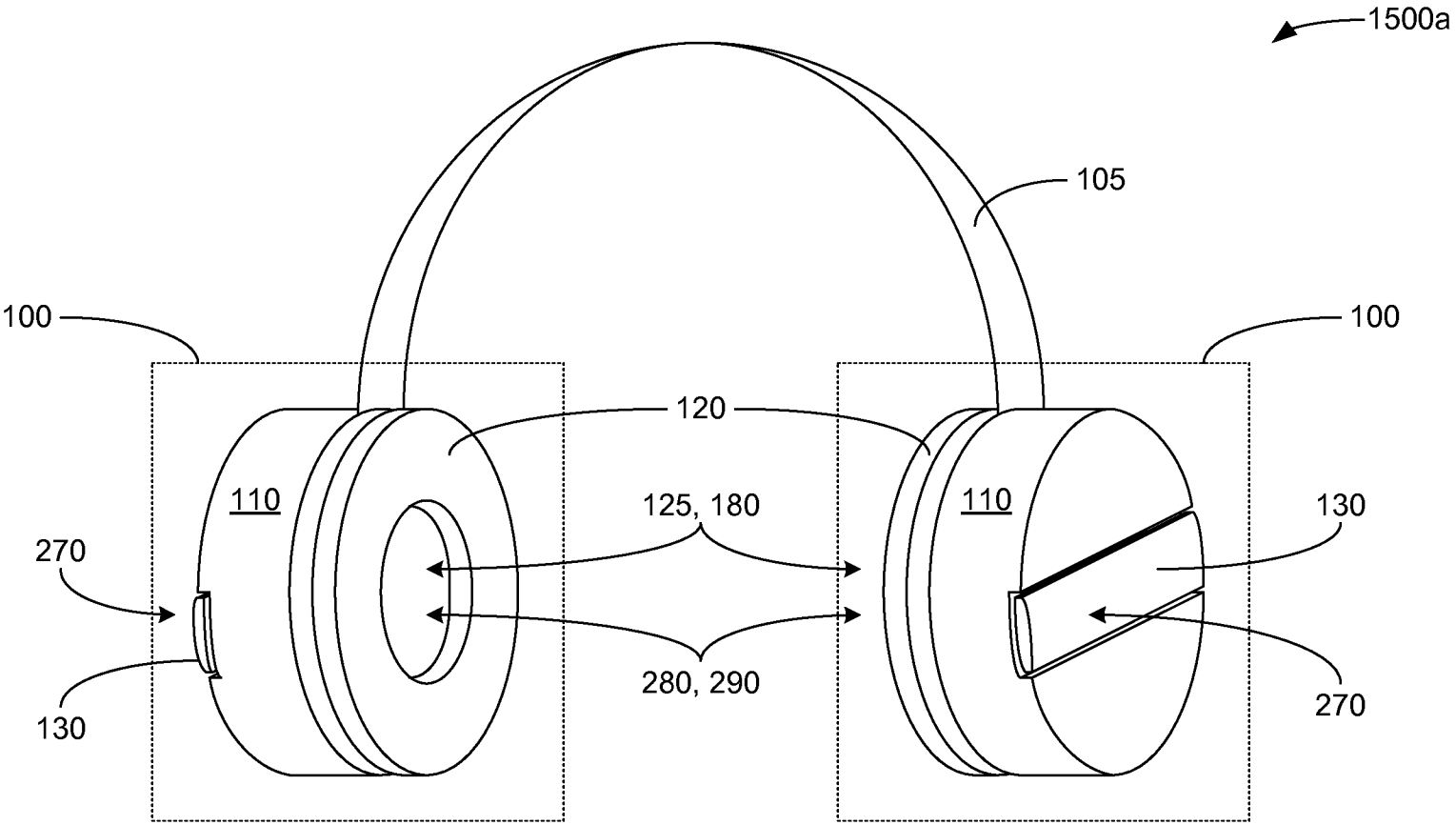
FIG. 2 is a perspective view of a personal ANR device into which the earpiece of FIG. 1 is incorporated.
Figure 5:
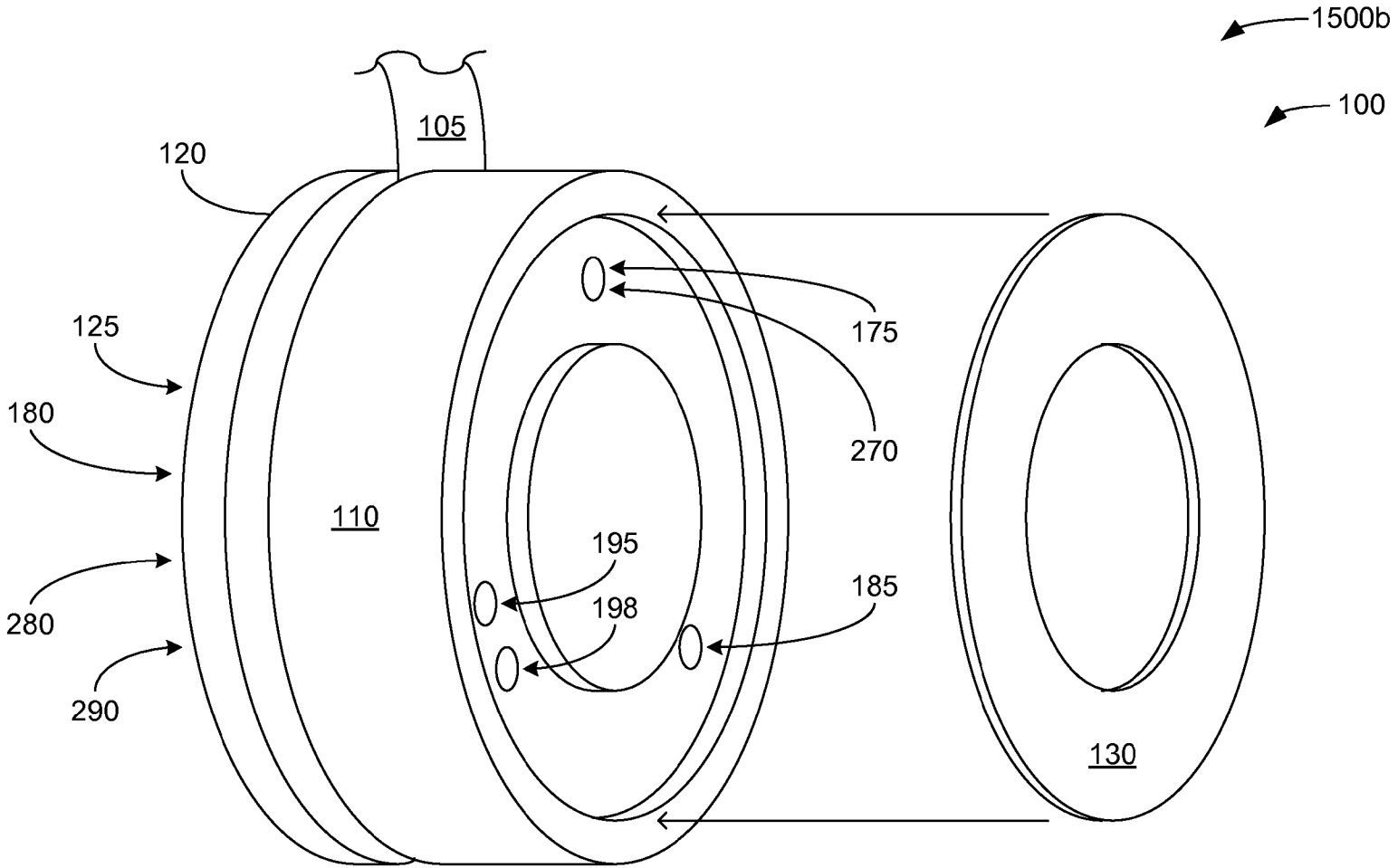
FIG. 5 is a perspective view of a variant of the personal ANR device of FIG. 2.
Figure 6:
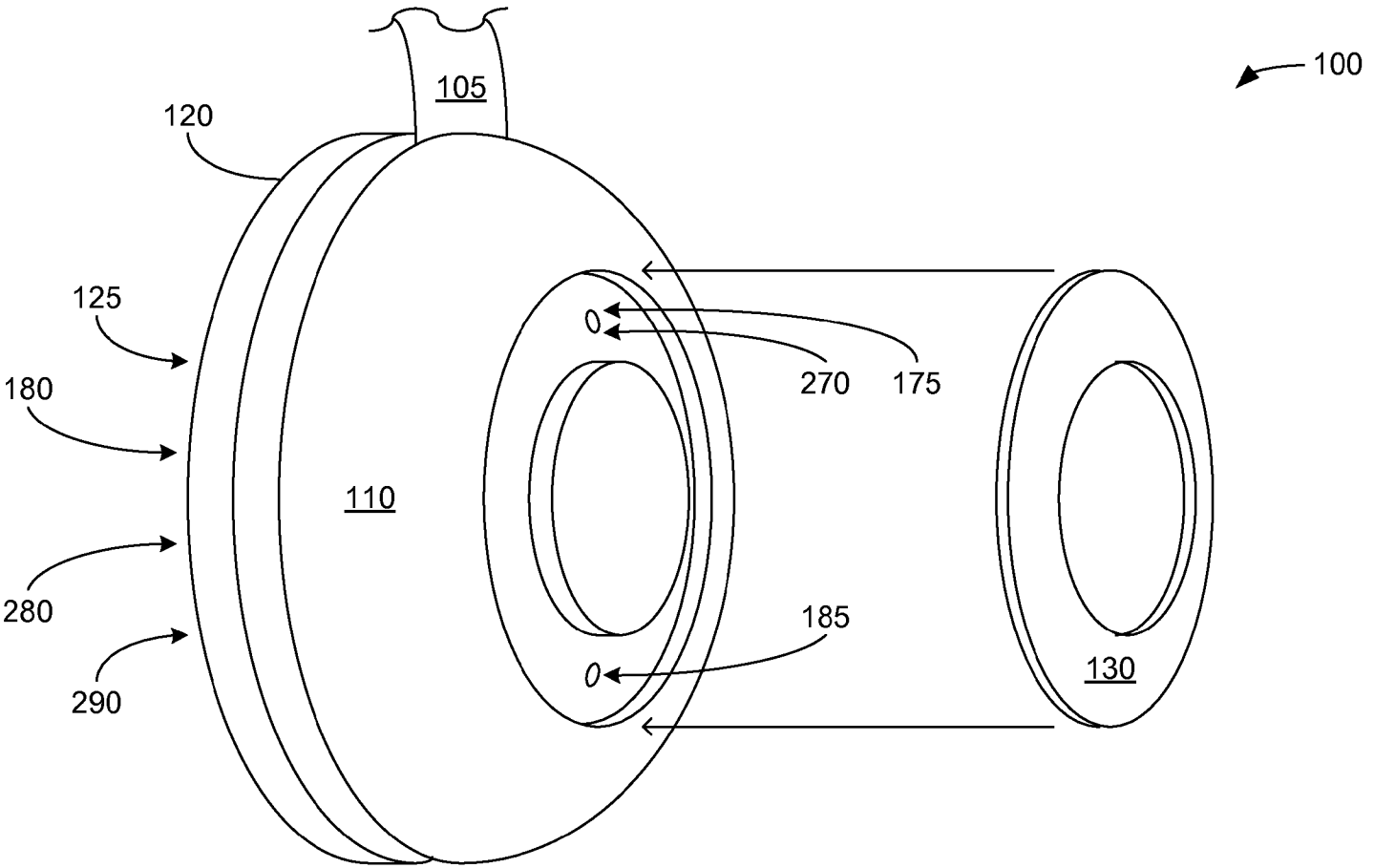
FIG. 6 is a perspective view of another variant of the personal ANR device of FIG. 2.

FIG. 1 provides a block diagram of personal ANR device 1000 structured to be worn by a user to provide active noise reduction (ANR) in the vicinity of at least one of the users ears. As will be explained in greater detail, the personal ANR device 1000 may have any of a number of physical configurations, possible ones of which are depicted in FIGS. 2, 5 and 6. Some possible physical configurations may incorporate a single earpiece 100 to provide ANR to only one of the users ears, and others incorporate a pair of earpieces 100 to provide ANR to both of the users ears. However, it should be noted that for the sake of simplicity of discussion, only a single earpiece 100 is depicted and described in relation to FIG. 1. It should also be noted that FIG. 1 is meant to serve as a conceptual diagram of the workings of one of the earpieces 100, and that FIG. 1 should not be taken as any form of scaled drawing or as any form of limiting depiction of relative positions of structures.

As depicted, the personal ANR device 1000 incorporates at least one ANR circuit 200 that provides ANR functionality to a single one of the earpieces 100. In physical configurations of the personal ANR device 1000 that incorporate only one of the earpieces 100, there may be only one of the circuit 200. However, in physical configurations incorporating two of the earpieces 100, there may either be a single one of the ANR circuit 200 to provide ANR functionality for both of the earpieces 100, or separate ones of the ANR circuit 200 may separately provide ANR functionality to each of the earpieces 100. The provision of whatever form of ANR by the personal ANR device 1000 may be in addition to the provision of some form of passive noise reduction (PNR) provided by the structure of each earpiece 100.

Also as depicted, the personal ANR device 1000 incorporates structure and microphones to provide both feedback-based and feedforward-based ANR. However, it should be noted that this specific depiction is meant to provide an example to enable understanding, and that other configurations are possible in which only the structure and microphone(s) required to provide only one or the other of feedback-based ANR or feedforward-based ANR are possible.

Each earpiece 100 incorporates a casing 110 having at least a front cavity 180 that is at least partly defined by the casing 110 and by at least a portion of an acoustic driver 290 disposed within the casing 110 to acoustically output at least ANR anti-noise sounds to a users ear. Where feedback-based ANR is provided, the front cavity 180 also encloses a feedback microphone 280. There may also be one or more of a rear cavity 190, a feedforward microphone cavity 170 and a circuit cavity 160. The rear cavity 190 (if present) is also at least partly defined by the casing 110 and by at least a portion of the acoustic driver 290. The acoustic driver 290 may disposed on a baffle positioned in a manner that essentially separates the front cavity 180 from the rear cavity 190, or may be more directly mounted to portions of the casing 110. The feedforward microphone cavity 170 (if present) encloses a feedforward microphone 270, and is defined largely by the casing 110. The circuit cavity 160 (if present) may be provided to enclose one or both of the ANR circuit 200 and a power source. As depicted, the circuit cavity 160 is at least partly defined by the casing 110 and a cover 140 that closes an access 165 that may be provided to enable insertion and removal of a removable power source (such as a battery, not shown). Although the feedforward microphone cavity 170 and the circuit cavity 160 are depicted as being substantially separated by the structure of the casing 110, those skilled in the art will readily understand that embodiments in which these two cavities are one and the same are possible.

The casing 110 carries an ear coupling 120 surrounding an opening to the front cavity 180 and having a passage 125 that is formed through the ear coupling 120 and that communicates with the front cavity 180. In some embodiments, an acoustically transparent screen, grill or other form of perforated panel (not shown) may be positioned in or near the passage 125 in a manner that obscures the front cavity 180 and/or the passage 125 from view for aesthetic reasons and/or to protect components within the casing 110 from damage. At times when the earpiece 100 is worn by a user in the vicinity of one of the user's ears, the passage 125 acoustically couples the front cavity 180 to the ear canal of that ear, while the ear coupling 120 engages portions of the ear to form at least some degree of acoustic seal therebetween. This acoustic seal enables the casing 110, the ear coupling 120 and portions of the user's head surrounding the ear canal (including portions of the ear) to cooperate to acoustically isolate the front cavity 180, the passage 125 and the ear canal from the environment external to the casing 110 and the user's head to at least some degree, thereby providing some degree of passive noise reduction (PNR).

In some variations, the ear coupling 120 may be fabricated from one or more flexible materials and shaped in a manner that enables the ear coupling 120 to be deformable to a degree sufficient to conform to the curved surfaces of the portions of the ear and/or the side of the head of the user such that the ear coupling 120 engages to provide at least some degree of PNR. Further, the one or more materials of the ear coupling 120 may be chosen to provide much of the PNR at higher audible frequencies (e.g., 1 KHz and above). This may be done in a manner that coordinates such provision of passive attenuation with structuring any ANR functionality to provide attenuation at lower audible frequencies such that the resulting combination provides attenuation across a wide range of audible frequencies (e.g., 20 Hz through 20 KHz).

In some variations, the rear cavity 190 may be coupled to the environment external to the casing 110 via one or both of a resistive port 195 and a mass port 198. If present, the resistive port 195 may be formed as an opening between the rear cavity 190 and the environment external to the casing 110 with a piece of acoustically resistive material 196 positioned within the resistive port 195, as depicted, or with a piece of resistive material overlying the resistive port 195 where the resistive port 195 opens either to the environment external to the casing 110 or into the rear cavity 190. If present, the mass port 198 may be formed as an opening between the rear cavity 190 and the environment external to the casing 110 having dimensions and/or a shape that tunes the resonance of the mass port 198 with the compliance of the rear cavity 190 to effectively acoustically couple the cavity 190 to the environment external to the casing 110 below a selected tuning frequency while acoustically isolating the rear cavity 190 from the environment external to the casing 110 above the tuning frequency. The provision of one or both of the resistive port 195 and the mass port 198 may be done to enhance characteristics of the acoustic output of sounds by the acoustic driver 290 (e.g., in acoustically outputting lower frequencies) and/or to enable the rear cavity 190 to be made smaller, as described in greater detail in U.S. Pat. No. 6,831,984 issued Dec. 14, 2004, to Roman Sapiejewski, assigned to Bose Corporation of Framingham, Mass., and hereby incorporated by reference.

Where the personal ANR device 100 provides feedforward-based ANR, the feedforward microphone 270 is disposed within the feedforward microphone cavity 170 in a manner that is acoustically accessible to the environment external to the casing 110. This enables the feedforward microphone 270 to detect environmental noise sounds, such as those emitted by an acoustic noise source 9900, in the environment external to the casing 110 without interference from any form of PNR or ANR that are provided by the personal ANR device 1000. As those familiar with feedforward-based ANR will readily recognize, these sounds detected by the feedforward microphone 270 are used by the ANR circuit 200 as a reference from which feedforward anti-noise sounds are derived and then acoustically output into the front cavity 180 by the acoustic driver 190. The derivation of the feedforward anti-noise sounds takes into account the characteristics of whatever PNR is provided, characteristics and position of the acoustic driver 290 relative to the feedforward microphone 270, and/or acoustic characteristics of the front cavity 180 and/or the passage 125. The feedforward anti-noise sounds are acoustically output by the acoustic driver 290 with amplitudes and phase shifts calculated to acoustically destructively interfere with the noise sounds of the acoustic noise source 9900 that are present within the front cavity 180, the passage 125 and/or an ear canal in a subtractive manner that attenuates them to some degree.

As depicted, the feedforward microphone 270 is isolated from vibrations that may be transmitted through at least an external portion of the casing 110 by a vibration isolator 176 through which is formed a passage that communicates between the feedforward microphone 270 and a feedforward aperture 175 formed through a portion of the casing 110 that defines at least a portion of the feedforward microphone cavity 170. Thus, acoustic access by the feedforward microphone 270 to the environment external to the casing 110 is provided through the feedforward aperture 175 and the passage formed through the vibration isolator 176. The feedforward microphone 270 may be affixed to a circuitboard (not shown) that is mounted to another portion of the casing 110 that provides a less direct coupling of the circuitboard to external portions of the casing 110 such that vibrations occurring in external portions of the casing 110 may be somewhat attenuated as they are transmitted to the circuitboard. Alternatively, the feedforward microphone 270 could be more directly coupled to a portion of the casing 110 and without the vibration isolator 176 interposed therebetween. On the exterior of the casing 110, a cover 130 overlies the feedforward aperture 175 in a manner that serves to maintain acoustic access to the environment external to the casing 110, as will be explained in greater detail.

In some variants of the personal ANR device 1000 providing feedforward-based ANR, the feedforward microphone 270 may serve one or more additional purposes beyond detecting feedforward reference noise sounds for the provision of feedforward-based ANR. By way of example, the feedforward microphone 270 may be disposed on the casing 110 at a position or in an orientation that is advantageous in enabling the feedforward microphone 270 to detect speech sounds uttered by a user of the personal ANR device 1000 such that the feedforward microphone 270 is able to also serve as a communications microphone to enable the personal ANR device 1000 to also serve as a two-way audio communications device. By way of another example, the ANR circuit 200 may be coupled to a manually-operable control (not shown) that is operable by a user of the personal ANR device 1000 to cause the ANR circuit 200 to modify the provision of feedforward-based ANR to enable at least speech sounds spoken by another person and detected by the feedforward microphone 270 to be conveyed substantially unmodified by at least feedforward-based ANR to the user's ear by being acoustically output by the acoustic driver 290.

Where the personal ANR device 1000 provides feedback-based ANR, the feedback microphone 280 is disposed within the front cavity 180 to detect sounds within the front cavity 180 and/or the passage 125. The sounds detected by the feedback microphone 280 are used as a reference from which the ANR circuit 200 derives feedback anti-noise sounds that the ANR circuit 200 drives the acoustic driver 290 to output into the front cavity 180. The derivation of the feedback anti-noise sounds takes into account the characteristics and position of the acoustic driver 290 relative to the feedback microphone 280, and/or the acoustic characteristics of the front cavity 180 and/or the passage 125. The feedback anti-noise sounds are acoustically output by the acoustic driver 290 with amplitudes and phase shifts calculated to acoustically destructively interfere with the noise sounds of the acoustic noise source 9900 that are present within the front cavity 180, the passage 125 and/or the ear canal in a subtractive manner that attenuates them to some degree.

As depicted, the ANR circuit 200 is disposed within the circuit cavity 160 of the earpiece 100. However, as those skilled in the art will readily recognize, a portion of or substantially all of the ANR circuit 200 may be disposed within another portion of the personal ANR device 1000 such that the circuit cavity 160 may not be present or the circuit cavity 160 may enclose another circuit and/or a power source. Where the casing 110 of the earpiece 100 does define a circuit cavity 160, the circuit cavity 160 may be structured to be accessible to the environment external to the casing 110 through the access 165, which may be structured to be closed with the cover 140, as previously discussed. Where the circuit cavity 160 is accessible by the access 165 and the access 165 is closable via the cover 140, the access 165 and/or the cover 140 may be structured so that the access 165 is closed by the cover 140 in a "leaky" manner such that the circuit cavity 160 continues to be acoustically accessible to the environment external to the casing 110. Further, where there is such a "leaky" closure of the circuit cavity 160 by the cover 140, the circuit cavity 160 may be further coupled to the front cavity 180 via a leak aperture 185. Alternatively and/or additionally, where there is such a "leaky" closure of the circuit cavity 160, the resistive port 195 and the mass port 198 may be positioned to indirectly couple the rear cavity 190 to the environment external to the casing 110 by coupling the rear cavity 190 to the circuit cavity 160.

In some variants, the leak aperture 185 may simply serve to enable equalization of air pressure between the front cavity 180 and the environment external to the casing 110 through the circuit cavity 160. In other variants, the leak aperture 185 may be dimensioned and/or shaped (i.e., tuned) to acoustically couple the front cavity 180 to the environment external to the casing 110 to a preselected degree across a preselected range of audible frequencies (e.g., given a generally circular shape with approximately a 1 mm diameter), possibly to control or alter the operation of the acoustic driver 290 in acoustically outputting anti-noise sounds into the front cavity 180. Although it may be possible to structure the casing 110 to position the leak aperture 185 to more directly communicate between the front cavity 180 and the environment external to the casing 110, indirect communication through the circuit cavity 160 (as has been described) may be deemed desirable as an approach to enhancing the aesthetics of the personal ANR device 1000 and/or to ensuring that debris or other foreign objects do not enter the leak aperture 185.

Where the personal ANR device 1000 provides both PNR and feedforward-based ANR, the leak aperture 185 may be provided to diminish the degree of PNR provided to a preselected extent across a chosen range of frequencies as a way to reduce variability in the provision feedforward-based ANR. It is possible to induce inconsistent operation in the provision of feedforward-based ANR where the extent of the acoustic seal provided by PNR intermittently changes between a substantially complete acoustic seal having no leaks and an acoustic seal with a leak. Such intermittent changes can occur in the case of users wearing glasses such that a portion of the frame of the glasses that engages a portion of the ear is interposed between the ear coupling 120 and a portion of the user's ear or head. Such intermittent changes can also occur where the shape of a user's ear and/or head results in an acoustic seal being susceptible to being broken as the user moves their head and/or their jaw.

As will be familiar to those skilled in the art, changes in the extent of the acoustic seal provided by PNR result in changes to the transfer function imposed on noise sounds emanating from the acoustic noise source 9900 as those noise sounds enter the front cavity 180. A change in that transfer function results in a change in the degree to which feedforward anti-noise sounds acoustically output into the front cavity are able to attenuate noise sounds that enter the front cavity 180. A change between an absence of a leak and the presence of a leak results in a greater change in that transfer function than simply a change between differing degrees of a leak that is always present.

The provision of the leak aperture 185 ensures that there is always at least a known degree of leakage between the front cavity 180 and the environment external to the casing 110. With this known degree of leakage always in place, any intermittent leaks that may occur between the ear coupling 120 and a portion of the users head and/or ear only increase or decrease the degree of leakage present, rather than causing intermittent changes between there being a leak and a complete absence of a leak. As those skilled in the art will readily appreciate, an intermittent change in only the degree of leakage is more easily accommodated in providing feedforward-based ANR, thereby aiding in ensuring greater consistency in the operation of feedforward-based ANR.

Where the personal ANR device 1000 provides PNR and both feedforward-based and feedback-based ANR, the greater consistency in the provision of feedforward-based ANR that is enabled by the leak aperture 185, in turn, enables these three forms of noise reduction to be more easily combined in a manner that provides a more consistent degree of noise reduction across a wide range of audible frequencies. More specifically, the provision of the known degree of leakage provided by the leak aperture 185 removes the need to structure the feedforward-based ANR to attempt to accommodate intermittent changes between the presence and complete absence of a leak such that there is greater freedom in structuring the feedforward-based ANR to provide selected degrees of attenuation across of a range of frequencies that better matches the degrees of attenuation and ranges of frequencies of the other two forms of noise reduction. Thus, for example, it becomes easier to structure the feedback-based ANR to provide noise reduction in lower audible frequencies, the feedforward-based ANR to provide noise reduction in lower to midrange frequencies, and the PNR to provide noise reduction in midrange to higher frequencies such that there is minimal variability in the resulting combined noise reduction across a wide range of audible frequencies.

In some variants of the personal ANR device 1000, the acoustic driver 290 may serve one or more additional purposes beyond acoustically outputting feedback and/or feedforward anti-noise sounds. By way of example, where the personal ANR device 1000 either incorporates the capability to play recorded audio or incorporates the ability to receive audio for being played from another device (e.g., a digital audio file player, a tape recorder, a radio, etc.), the acoustic driver 290 may also serve to acoustically output such audio. By way of another example, where the personal ANR device 1000 incorporates the ability to serve as a two-way audio communications device (perhaps with the feedforward microphone 270 additionally serving as a communications microphone, as previously described), the acoustic driver 290 may also serve to acoustically output audio received as part of two-way audio communications.

FIG. 2 depicts an "over-the-head" physical configuration 1500*a* that may be adopted by the personal ANR device 1000. The physical configuration 1500*a* incorporates a pair of earpieces 100 that are each in the form of an earcup, and that are connected by a headband 105. However, and although not specifically depicted, an alternate variant of the physical configuration 1500*a* may incorporate only one of the earpieces 100 connected to the headband 105. Further, another alternate variant of the physical configuration 1500*a* may replace the headband 105 with a different band structured to be worn around the back of the head and/or the back of the neck of a user.

In the physical configuration 1500*a*, each of the earpieces 100 may be either an "on-ear" (also commonly called "supra-aural") or an "around-ear" (also commonly called "circum-aural") form of earcup, depending on their size relative to the pinna of a typical human ear. As previously discussed, each of the earpieces 100 has the casing 110 that carries the ear coupling 120. In this physical configuration, the ear coupling 120 is in the form of a flexible cushion (possibly ring-shaped) that surrounds the periphery of the opening into the front cavity 180 in which at least the acoustic driver 290 is disposed, and that has the passage 125 formed therethrough that communicates with the front cavity 180. As also previously discussed where feedforward ANR is provided, the casing 110 of each of the earpieces 100 also carries a cover 130 that overlies the feedforward aperture 175 that provides the feedforward microphone 270 with acoustic access to the environment external to the casing 110.

Portions of the casing 110 and/or of the ear coupling 120 cooperate to engage portions of the pinna of a user's ear and/or portions of a user's head surrounding the pinna to enable the casing 110 to acoustically couple the front cavity 180 with the ear canal through the ear coupling 120. Thus, when the earpiece 100 is properly positioned, the entrance to the ear canal is substantially "covered" to create some degree of acoustic seal that provides some degree of PNR.

Although not specifically depicted, other variants of the physical configuration 1500*a* may further incorporate one or more communications microphones to enable the personal ANR device 1000 to support two-way communications, in addition to providing ANR. More specifically, a variant of the physical configuration 1500*a* (i.e., a headset) may provide a communications microphone supported at the end of microphone boom coupled to an earpiece 100 to be positioned in the vicinity of a users mouth.

Figure 3:
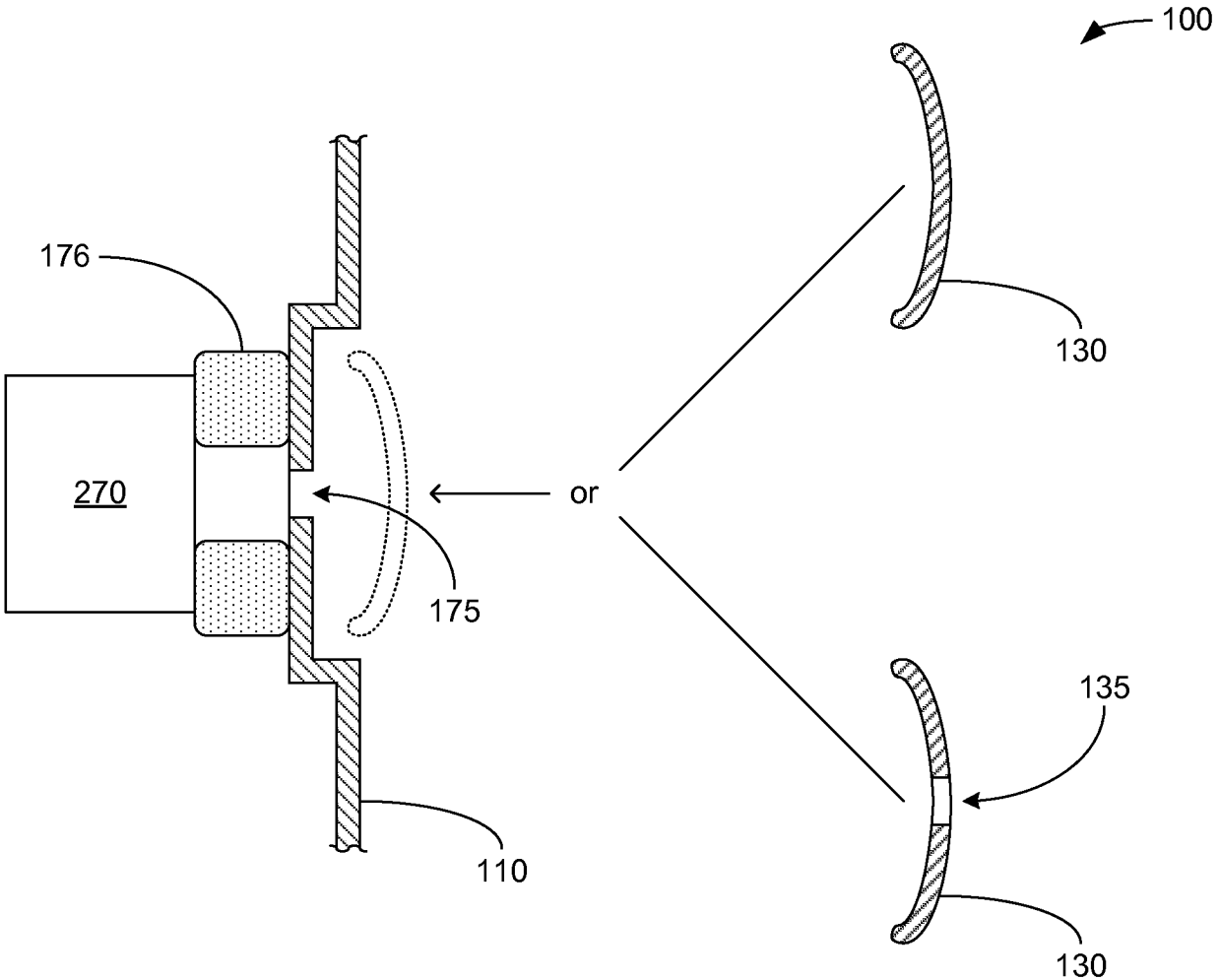
FIG. 3 is a cross-section of a portion of the personal ANR device of FIG. 2.

FIG. 3 depicts a cross-section of a portion of the casing 110 of one of the earpieces 100 of the physical configuration 1500*a* of the personal ANR device 1000 in the vicinity of the feedforward microphone aperture 175. As is depicted in greater detail, the cover 130 overlies an inset portion of the exterior of the casing 110 that includes the location at which the feedforward microphone aperture 175 is formed through a portion of the casing 110. As is also depicted, the cover 130 is spaced away from that portion of the exterior of the casing 110 such that acoustic access is still provided between the feedforward microphone aperture 175 and the environment external to the casing 110 around the periphery of the generally sheet-like shape of the cover 130. In other words, although the cover 130 overlies the feedforward microphone aperture 175, it is a "leaky" cover insofar as such acoustic access is enabled even as the cover is so positioned. Thus, the cover 130 provides some degree of physical protection for the aperture 175 to at least resist the entry of debris or other foreign objects into the aperture 175, while still enabling the feedforward microphone 270 to detect environmental noise sounds in the environment external to the casing 110. Further still, as depicted, the cover 130 protrudes somewhat beyond the inset formed in the exterior of the casing 110 such that the cover 130 is substantially non-coplanar with the casing 110, although as will be discussed further, other variants of the cover 130 may not protrude beyond an inset in this manner.

As also depicted in FIG. 3, the cover 130 may or may not incorporate one or more apertures 135 formed therethrough, and one or more of the apertures 135 may be formed through the cover 130 at a location that overlies the feedforward microphone aperture 175. Any of a variety of well known connective structures may be employed to couple the cover 130 to the casing 110 in a manner that holds the cover 130 in the position depicted in which the cover is spaced away from the casing 110 as described. It is likely that the extent of the open area afforded by the combination of leaks about the periphery of the cover 130 and any of the apertures 135 that may be present will likely be far greater than the open area provided by the feedforward microphone aperture 175. Indeed, this may be deemed desirable in order to avoid impairing the provision of feedforward-based ANR by causing the cover 130 to provide less open area than is provided by the feedforward microphone aperture 175.

Figure 4B:
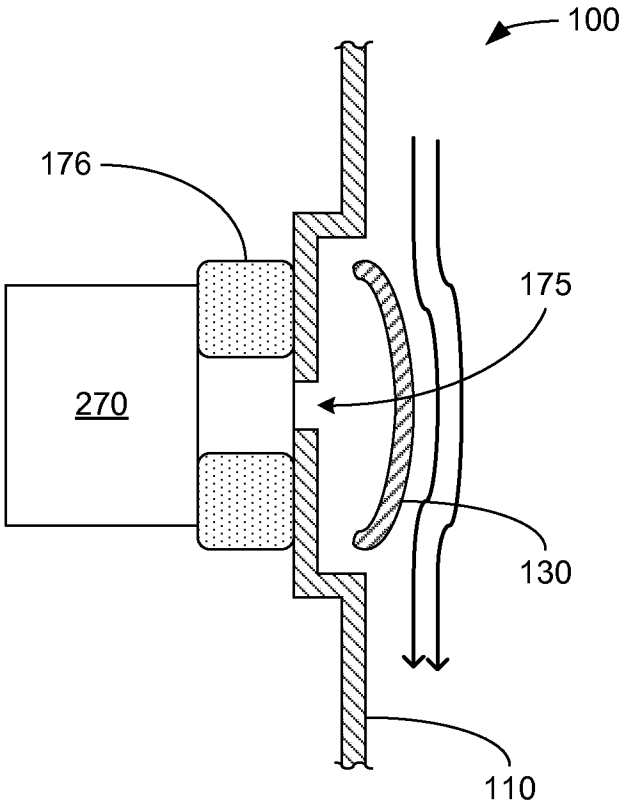
FIGS. 4*a* and 4*b* are cross-sections of a portion of the personal ANR device of FIG. 2, and similar to FIG. 3, but depicting ways in which the access of a feedforward microphone to a surrounding environment is enabled.
Figure 4A:
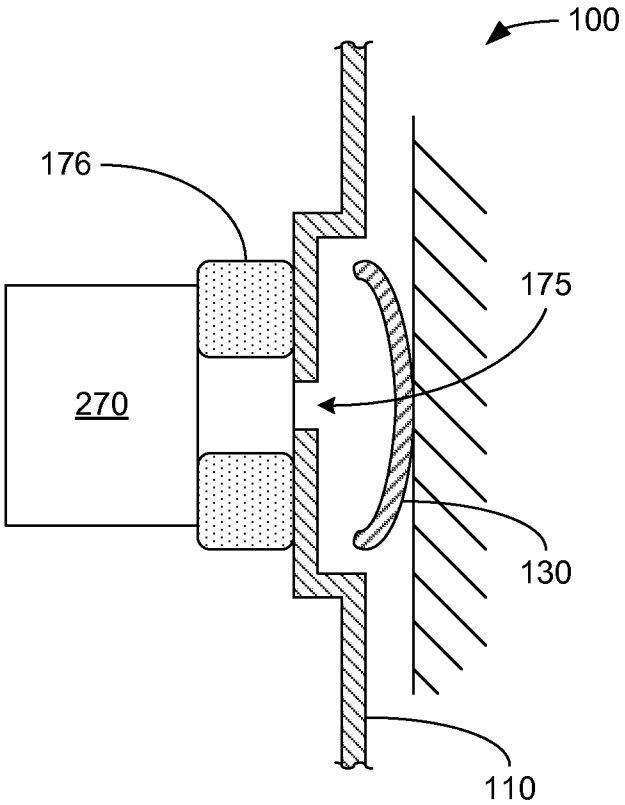

FIGS. 4*a* and 4*b* are cross-section views substantially similar to the cross-section view provided in FIG. 3, but each depicting an aspect of the cover 130 that aids in ensuring that the feedforward microphone 270 continues to have acoustic access to the environment external to the casing 110.

In FIG. 4*a*, a situation is depicted in which the portion of the casing 110 through which the feedforward aperture 175 is formed is pressed against a foreign object such that the possibility of the feedforward aperture 175 being physically occluded is presented. However, as is also depicted, both the presence of the cover 130 overlying the vicinity of the feedforward aperture 175 and the positioning of the cover 130 relative to the exterior of the casing 110 such that the cover 130 protrudes somewhat beyond the plane of the exterior of the casing 110 act to keep the foreign object spaced away from the casing 110 to enough of a degree that such occlusion does not occur. As a result, the feedforward microphone 270 continues to have acoustic access to the environment external to the casing 110 such that proper operation of feedforward-based ANR remains possible.

In FIG. 4*b*, a situation is depicted in which wind of considerable strength passes the portion of the casing 110 through which the feedforward aperture 175 is formed such that the possibility is presented of vortices being formed in the vicinity of the feedforward microphone 270 such that wind noise may be generated. As has been previously discussed, wind noise involving a microphone generally occurs as a result of the passage of a suitably strong wind current in the vicinity of a diaphragm of a microphone such that the diaphragm is subjected to rapidly changing local air pressures that intermittently push and pull the diaphragm in a manner that causes the microphone to output a signal that is perceived by the human ear as a low-frequency rumbling noise.

As depicted in FIG. 4*b*, the positioning of the cover 130 in the manner that has been described tends to maintain some degree of separation between a wind current and the feedforward aperture 175. Although air currents associated with such wind currents may still reach the feedforward aperture 175, the positioning of the cover 130 in a manner that is partially recessed within an inset reduces the strength and/or speed of any such air currents reaching the feedforward aperture 175.

As a result, the creation of vortices in the vicinity of the feedforward aperture 175 is largely prevented, and what few of such vortices may be created are of sufficiently reduced strength that their ability to exert pressure on the diaphragm of the feedforward microphone 270 is greatly reduced.

FIGS. 5 and 6 depict a portion of alternate physical configurations 1500*b* and 1500*c*, respectively, of the personal ANR device 1000. Many of the details of the earpieces 100 in both of the physical configurations 1500*b* and 1500*c* are similar to those of the earpieces 100 of the physical configuration 1500*a*. However, in both of the physical configurations 1500*b* and 1500*c*, the cover 130 is of a generally ring-shaped physical configuration meant to overly an inset formed in the casing 110 that also has a generally ring-shaped configuration. Further, and as depicted in each of FIGS. 5 and 6, the cover 130 of each of the physical configurations 1500*b* and 1500*c* overly more than just the feedforward microphone aperture 175, with the leak aperture 185, the resistive port 195 and the mass port 198 being variously depicted in FIGS. 5 and 6 as being other openings formed through portions of the casing 110 that may be overlain by the cover 130.

The ring-shaped configuration of the cover 130 (and possibly also of an inset formed in the casing 110) of the physical configurations 1500*b* and 1500*c* results in the cover 130 extending over much of the exterior of the casing 110, unlike the more limited degree to which the cover 130 of the physical configuration 1500*a* extended over the exterior of the casing 110. By extending over more of the exterior of the casing 110 in the physical configurations 1500*b* and 1500*c*, the cover 130 more effectively serves to prevent the possible occlusion of whatever openings it may overly arising from a user placing the palm of a hand over the exterior of the casing 110 at times when the user is adjusting the position of the earpiece 100, or is perhaps operating a control (not shown) that may be disposed on the exterior of the casing 110. Indeed, a combination of such a widely extending variant of the cover 130 overlying the microphone aperture 175 and some variant of the leak aperture 185 may be used to ensure the continued consistent operation of feedforward-based ANR (as has been described) at a time when the user grasps the earpiece 100 in the palm of a hand to adjust the position of the earpiece 100 or otherwise move the earpiece 100 about relative to an ear of the user. In some variants, the cover 130 extends over enough of the exterior casing 110 as to ensure that a palm of a hand of at least an average-sized adult will not be large enough to cover the entirety of the cover 130. In other variants, a portion of the cover 130 extends over a portion of the exterior of the casing 110 that a user is unlikely to choose to cover with the palm of a hand.

Where the cover 130 overlies the feedforward microphone aperture 175, and where any of the other depicted openings are also overlain by the same cover 130, care must be taken to ensure that anti-noise sounds acoustically output by the acoustic driver 290 are not conveyed to the feedforward aperture 175 from any of the other such openings. Allowing such a conveyance of anti-noise sounds could create an acoustic feedback loop between the acoustic driver 290 and the feedforward microphone 270 that may impair the provision of feedforward-based ANR and/or cause the generation of additional noise sounds by the acoustic driver 290.

Similarly, where the cover 130 overlies the leak aperture 185, and where either of the resistive port 195 or the mass port 198 are also overlain by the same cover 130, care must be taken to ensure that sounds acoustically output by the acoustic driver 290 in the rear cavity 190 as the acoustic driver 290 acoustically outputs anti-noise sounds in the front cavity 180 are not conveyed to the leak aperture 185. Allowing such a conveyance of the sounds from the rear cavity 190 may result in the feedback microphone 280 (if present) being exposed to a version of the anti-noise sounds that are acoustically out of phase with the anti-noise sounds being acoustically output by the acoustic driver 290 in the front cavity 180. Again, a feedback loop impairing the provision of ANR may be created.

Figure 7:
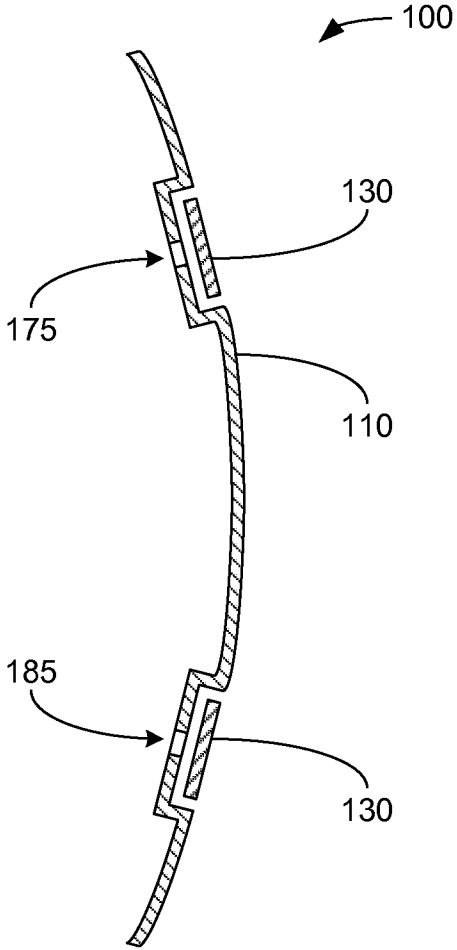
FIG. 7 is a cross-section of a portion of the variant of personal ANR device depicted in FIG. 6.

FIG. 7 depicts a cross-section of a portion of the casing 110 of one of the earpieces 100 of the physical configuration 1500*c* (depicted in FIG. 6) of the personal ANR device 1000 in the vicinity of both the feedforward microphone aperture 175 and the leak aperture 185. As is depicted in greater detail, although the cover 130 is positioned within an inset formed in the exterior of the casing 110 as was also shown for the physical configuration 1500*a* depicted in cross section in FIG. 3, the cover 130 in the physical configuration 1500*c* does not protrude beyond the plane of nearby portions of the casing 110 as does the cover 130 in the physical configuration 1500*a*. Such a protrusion of the cover 130 in the physical configuration 1500*c* may be deemed unnecessary due to the rounded shape of the exterior of the casing 110 of the physical configuration 1500*c* which may be deemed capable of preventing occlusions of the microphone aperture 175 (and of the leak aperture 185) when pressed against a foreign object to the same degree as the protruding variant of the cover 130 depicted in cross-section in FIG. 4*a*.

It should be noted that although the feedforward microphone 170 has been described and depicted as having access to the environment external to the casing 110 through an aperture (such as the feedforward microphone aperture 175), in alternate variants, the feedforward microphone 170 may be enclosed in a cavity of the casing 110 (such as the circuit cavity 160) without the provision of a distinct feedforward aperture. In some of such variants, such a cavity may be acoustically coupled to the environment external to the casing 110 through one or more leaks, such as the leaks between the circuit cavity 160 and the environment external to the casing that are enabled by the "leaky" closure of the circuit cavity 160 provided by the cover 140. In others of such alternate variants, such a cavity may be sufficiently sealed such that there is no transfer of air pressure between such a cavity and the environment external to the casing 110 (either directly or through another cavity), and acoustic coupling of such a cavity to the environment external to the casing is accomplished through the transmission of vibrations through portions of the casing 110 that convey environmental noise sounds (such as those emanating from the acoustic noise source 9900) through the materials making up the casing 110 and into that cavity. Where such an indirect transmission of environmental noise sounds through portions of the casing 110 are relied upon, various techniques may be employed in equalization, filtering and/or other modifications of the electrical signal output by the feedforward microphone 170 to derive an electrical representation of the environmental noise sounds that is more akin to an electrical representation that would be provided by providing the feedforward microphone 170 with more direct acoustic access to the environment external to the casing 110.

Further, it should be noted that although the ANR device 1000 has been discussed and depicted as having one or more of the earpieces 100 that have the form of an earcup meant of either an "on-ear" ("supra-aural") or an "around-ear" ("circum-aural") physical configuration, in alternate variants, the one or more of the earpieces 100 may be of an "in-ear" (also commonly called "intra-aural) physical configuration in which the ear coupling 120 (if not also a portion of the casing 110) is meant to be worn at least partly inserted into a portion of an ear, such as in the concha and/or the ear canal of an ear. An example form of the ANR device 1000 having an earpiece having such a physical configuration may be that of wireless headset (also commonly called an "earset").

Other implementations are within the scope of the following claims and other claims to which the applicant may be entitled.

The invention claimed is:

1. An earpiece of an ANR device comprising:

a casing;

a feedforward microphone carried by the casing to enable the provision of feedforward-based ANR;

a feedforward aperture formed through an external surface of the casing to acoustically couple the feedforward microphone to an environment external to the casing to enable the feedforward microphone to detect noise sounds present in the environment external to the casing; and a cover structured to be disposed on the casing to overlie the feedforward aperture to provide a leaky closure over the feedforward aperture that enables the feedforward microphone to remain acoustically coupled to the environment external to the casing, wherein:

the earpiece further comprises an inset formed in the external surface of the casing;

the feedforward aperture opens through the external surface at a location where the feedforward aperture opens into the inset; and the cover is structured to be disposed at least partly within the inset in a manner that provides a leak between at least one edge of the cover and a portion of the inset, and wherein a portion of the cover protrudes from the inset to prevent a foreign object with a flat face from occluding the entirety of the inset to preserve the acoustic coupling of the feedforward microphone to the environment external to the casing.

2. The earpiece of claim 1, wherein an outer aperture is formed through the cover at a location that aligns with the feedforward aperture.

3. The earpiece of claim 1, wherein:

the casing defines a front cavity in which an acoustic driver of the earpiece acoustically outputs at least anti-noise sounds as part of the provision of feedforward-based ANR, the front cavity having an opening structured to enable the front cavity to be acoustically coupled to an ear of a user of the ANR device;

the earpiece further comprises a leak aperture formed through the external surface of the casing that acoustically couples the front cavity to the environment external to the casing; and the cover is structured to overlie the leak aperture.

4. The earpiece of claim 3, wherein:

the leak aperture opens through the external surface of the casing at a location where the leak aperture opens into the inset.

5. The earpiece of claim 3, wherein the location at which the feedforward aperture opens through the external surface is spaced apart from the location at which the leak aperture opens through the external surface to substantially prevent an occurrence of feedback in which sounds acoustically output by the acoustic driver are conveyed to the feedforward microphone through the leak aperture, along the cover and through the feedforward aperture.

6. The earpiece of claim 1, wherein:

the earpiece further comprises an acoustic driver to acoustically output at least anti-noise sounds as part of the provision of feedforward-based ANR;

the casing defines a front cavity and a rear cavity that are at least partially separated by the acoustic driver, the front cavity having an opening structured to enable the front cavity to be acoustically coupled to an ear of a user of the ANR device;

the earpiece further comprises at least one of a resistive port and a mass port formed through the external surface of the casing that couples the rear cavity to the environment external to the casing; and the cover is structured to overlie the at least one of the resistive port and the mass port.

7. The earpiece of claim 6, wherein the at least one of the resistive port and the mass port opens through the external surface of the casing at a location where the at least one of the resistive port and the mass port opens into the inset.

8. The earpiece of claim 6, wherein the earpiece further comprises a leak aperture formed in the casing that acoustically couples the front cavity to the environment external to the casing;

the earpiece further comprises a feedback microphone disposed within the front cavity to enable the feedback microphone to detect noise sounds present in the front cavity to enable the provision of feedback-based ANR; and the location at which the feedforward aperture opens through the external surface is spaced apart from the location at which the at least one of the resistive port and the mass port opens through the external surface to substantially prevent an occurrence of feedback in which sounds acoustically output by the acoustic driver are conveyed to the feedback microphone through the at least one of the resistive port and the mass port, along the cover and through the leak aperture.

9. An earpiece of an ANR device comprising:

a casing;

a feedforward microphone carried by the casing to enable the provision of feedforward-based ANR;

a feedforward aperture formed through an external surface of the casing to acoustically couple the feedforward microphone to an environment external to the casing to enable the feedforward microphone to detect noise sounds present in the environment external to the casing; and a cover structured to be disposed on the casing to overlie the feedforward aperture to provide a leaky closure over the feedforward aperture that enables the feedforward microphone to remain acoustically coupled to the environment external to the casing, wherein:

the earpiece further comprises an inset formed in the external surface of the casing;

the feedforward aperture opens through the external surface at a location where the feedforward aperture opens into the inset; and the cover is structured to be disposed at least partly within the inset in a manner that provides a leak between at least one edge of the cover and a portion of the inset, and wherein:

a portion of the external surface of the casing is curved;

at least a portion of the inset is formed in the curved portion of the external surface; and the curved portion of the external surface, the inset and the cover cooperate to prevent a foreign object with a flat face from occluding the entirety of the inset to prevent the acoustic coupling of the feedforward microphone to the environment external to the casing from being lost.

10. The earpiece of claim 9, wherein:

the cover is ring shaped; and the inset is ring shaped so as to receive at a least a portion of the ring shape of the cover within the inset.

11. The earpiece of claim 9, wherein the cover and the inset extend about the external surface of the casing to an extent great enough to prevent the leak between the at least one edge of the cover and the portion of the inset from being entirely occluded as a result of a hand of a user of the earpiece being placed over the external surface of the casing.

12. An ANR device comprising a first earpiece, the first earpiece comprising:

a first casing;

a first feedforward microphone carried by the first casing to enable the provision of feedforward-based ANR to a first ear of a user of the ANR device;

a first feedforward aperture formed through an external surface of the first casing to acoustically couple the first feedforward microphone to an environment external to the first casing to enable the first feedforward microphone to detect noise sounds present in the environment external to the first casing; and a first cover structured to be disposed on the first casing in a position to overlie the first feedforward aperture to provide a leaky closure by which the first feedforward microphone remains acoustically coupled to the environment external to the first casing, wherein:

the first earpiece further comprises a first inset formed in the external surface of the first casing;

the first feedforward aperture opens through the external surface of the first casing at a location where the first feedforward aperture opens into the first inset; and the first cover is structured to be disposed at least partly within the first inset in a manner that provides a leak between at least one edge of the first cover and a portion of the first inset, and wherein:

a portion of the external surface of the first casing is curved;

at least a portion of the first inset is formed in the curved portion of the external surface of the first casing; and the curved portion of the external surface of the first casing, the first inset and the first cover cooperate to prevent a foreign object with a flat face from occluding the entirety of the first inset to preserve the acoustic coupling of the first feedforward microphone to the environment external to the first casing.

13. The ANR device of claim 12 further comprising:

a second earpiece, the second earpiece comprising:

a second casing;

a second feedforward microphone carried by the second casing to enable the provision of feedforward-based ANR to a second ear of the user;

a second feedforward aperture formed through an external surface of the second casing to acoustically couple the second feedforward microphone to an environment external to the second casing to enable the second feedforward microphone to detect noise sounds present in the environment external to the second casing; and a second cover structured to be disposed on the second casing in a position between the second feedforward aperture and the environment external to the second casing, to overlie the second feedforward aperture to provide a leaky closure by which the second feedforward microphone remains acoustically coupled to the environment external to the second casing; and a band coupling the first casing to the second casing to enable the ANR device to be worn on the users head.

14. The ANR device of claim 13, further comprising a manually operable control operable by the user to signal an ANR circuit to alter at least the provision of feedforward-based ANR to the first ear of the user to enable speech sounds uttered by another person in the vicinity of the user that are detected by at least the first feedforward microphone to be acoustically output by at least a first acoustic driver of the first earpiece to at least the first ear of the user.

15. The ANR device of claim 12, wherein:

the ANR device is structured to be employed in two-way communications between the user and another person; and the first feedforward microphone is carried by the first casing a location enabling the first feedforward microphone to detect speech sounds uttered by the user to enable transmission of the detected speech sounds of the user to the other person.

16. The ANR device of claim 12, wherein a first outer aperture is formed through the first cover at a location that aligns with the first feedforward aperture.

17. The ANR device of claim 12, wherein:

the first cover is ring shaped; and the first inset is ring shaped so as to receive at a least a portion of the ring shape of the first cover within the first inset.

* * * * *